United States Patent [19]

Mokadam

[11] Patent Number: 4,809,521

[45] Date of Patent: Mar. 7, 1989

[54] LOW PRESSURE RATIO HIGH EFFICIENCY COOLING SYSTEM

[75] Inventor: Raghunath G. Mokadam, Rockford, Ill.

[73] Assignee: Sundstrand Corporation, Rockford, Ill.

[21] Appl. No.: 82,444

[22] Filed: Aug. 6, 1987

[51] Int. Cl.[4] ..... F25B 41/00

[52] U.S. Cl. ..... 62/498; 62/114; 62/513

[58] Field of Search ..... 62/114, 117, 113, 513, 62/512, 498, 502

[56] References Cited

U.S. PATENT DOCUMENTS 3,768,273 10/1973 Missimer .
4,598,556 7/1986 Mokadam .
4,689,964 9/1987 St. Pierre ..... 62/114

FOREIGN PATENT DOCUMENTS 278076 8/1911 Fed. Rep. of Germany .

*Primary Examiner*—Henry A. Bennet
*Attorney, Agent, or Firm*—Wood, Dalton, Phillips, Mason & Rowe

[57] ABSTRACT

A vapor compression cooling system operating at a pressure ratio of about 4 or less includes a compressor 10 having a inlet 12 and an outlet 14, a countercurrent condenser 20 connected to the compressor outlet 14 and a countercurrent evaporator 52 connected to the compressor inlet 12. A first heat exchanger 30 interconnects the condenser 20 and a second heat exchanger 38 which in turn is connected to the evaporator 52 via an expansion valve 46. The heat exchangers 30 and 38 have countercurrent flow paths and provide a path including an expansion valve 48 to the compressor inlet 12.

9 Claims, 2 Drawing Sheets

LOW PRESSURE RATIO HIGH EFFICIENCY COOLING SYSTEM

FIELD OF THE INVENTION

This invention relates to a low pressure ratio, high efficiency vapor compression refrigeration or cooling system which employs a non-azeotropic binary fluid.

BACKGROUND OF THE INVENTION

Refrigeration or cooling systems generally use a single refrigerant in a vapor compression cycle. In such a case, the phase change of the refrigerant in the evaporator and in the condenser will be at constant temperature for all practical purposes.

In the usual case, a mismatch leading to poor performance from the efficiency standpoint occurs. For in general, the heat source stream (the stream being cooled) in the evaporator and the heat sink stream (the stream cooling the refrigerant) in the condenser exchange heat sensibly, that is, without regard to the latent heat of fusion and/or vaporization of the material forming such heat streams. As a consequence, as the heat source stream passes through the evaporator, its temperature continuously decreases while as the heat sink stream passes through the condenser, its temperature continually increases, both toward the temperature value of the system refrigerant at that particular location in the system.

As is well known, the rate of heat transfer in a given system is proportional to the temperature differential with the result that as heat source stream or heat sink stream temperatures approach refrigerant temperature, the rate of heat transfer slows.

In order to avoid insufficient rates of heat transfer, such systems have conventionally utilized relatively large blowers or fans to rapidly move the heat sink stream through the condenser to maintain desirably high temperature differentials. Of course, work must be expended to generate the relatively high flow rates of such fluid streams and such has a negative effect on system efficiency.

In order to overcome these difficulties, in my commonly assigned U.S. Pat. No. 4,598,556 issued July 8, 1986, there is disclosed a system that minimizes the work required to direct a heat sink fluid across the condenser while maintaining a sufficient temperature differential to obtain good heat exchange to thereby increase system efficiency. When used to its maximum efficiency, the system of my patent will employ a pressure ratio of six or more (pressure ratio being defined as the ratio of compressor discharge pressure, absolute, to compressor suction pressure, absolute). This in turn requires, as a practical matter, the use of a multiple stage compressor, which is to say, incoming vapor is first compressed in one compressor stage and then passed to a second compressor stage where it is further compressed, etc.

Multiple stage compressors are, of course, more expensive and complex than single stage compressors. In addition, they are generally of considerably greater weight; and this factor mitigates against their employment in systems that are intended to be utilized, for example, in airborne vehicles.

In addition to my previously identified patent, attention is directed to U.S. Pat. No. 3,768,273 issued Oct. 30, 1973 to Missimer. Missimer discloses a vapor compression cooling system especially designed for obtaining extremely low temperatures. The same has some features in common with my previously identified patent, though it lacks the specific arrangement of heat exchangers that provides for improved efficiency in my prior patent. Missimer is also required to utilize a multiple stage compressor because it utilizes pressure ratios of ten or more.

Thus, the present invention is intended to provide a high efficiency vapor compression cooling system operating on a pressure ratio of four or less enabling the use of a single stage compressor.

SUMMARY OF THE INVENTION

It is the principal object of the invention to provide a new and improved vapor compression cooling system. More specifically, it is an object of the invention to provide such a system that may operate at high efficiency at low pressure ratios of about four or less enabling the use of a single stage compressor and facilitating use of the system in airborne vehicles or the like where weight and/or complexity are of concern.

An exemplary embodiment of the invention achieves the foregoing objects in a construction including a single stage compressor for a binary fluid of the non-azeotropic variety and operable, in a single compression step to compress the vapor of the binary fluid. The compressor has an inlet and an outlet and a condenser is connected to the compressor outlet for receiving compressed vapor and cooling the same to condense it. The system also includes an evaporator for evaporating condensed vapor and it in turn has a fluid inlet and a fluid outlet. The system further includes a first expansion device which is connected to the fluid inlet of the evaporator and a first heat exchanger having a first flow path connected to the condenser and a second flow path in countercurrent relation to the first flow path and in fluid communication with the compressor inlet. A second heat exchanger also has a first flow path in countercurrent relation to a second flow path. The second heat exchanger's first flow path is connected to the first flow path of the first heat exchanger and to the first expansion valve at the first junction. The second flow path of the second heat exchanger is also connected at a second junction to the first heat exchanger. A second expansion device is interposed between the first junction and the second heat exchanger's second flow path and means are provided to interconnect the evaporator fluid outlet and the second junction.

In one embodiment of the invention, the two heat exchangers are the sole heat exchangers interposed between the condenser and the evaporator. In another embodiment of the invention, the first and second expansion devices are the sole expansion devices in the system.

Preferably, the first and second heat exchangers are the sole heat exchangers interposed between the condenser and the evaporator and the first and second expansion devices are the sole expansion devices in the system and may be in the form of expansion valves.

Where the compressor is motor driven, the invention also contemplates that the compressor include a motor/controller means and that the first heat exchanger's second flow path be in fluid communication with the compressor inlet via the motor/controller means so as to provide cooling for the motor/control means. It is also possible that the compressor may be driven by mechanical means such as a turbine.

Other objects and advantages will become apparent from the following specification taken in connection with the accompanying drawings.

DESCRIPTION OF THE PREFERRED EMBODIMENT

Figure 1:
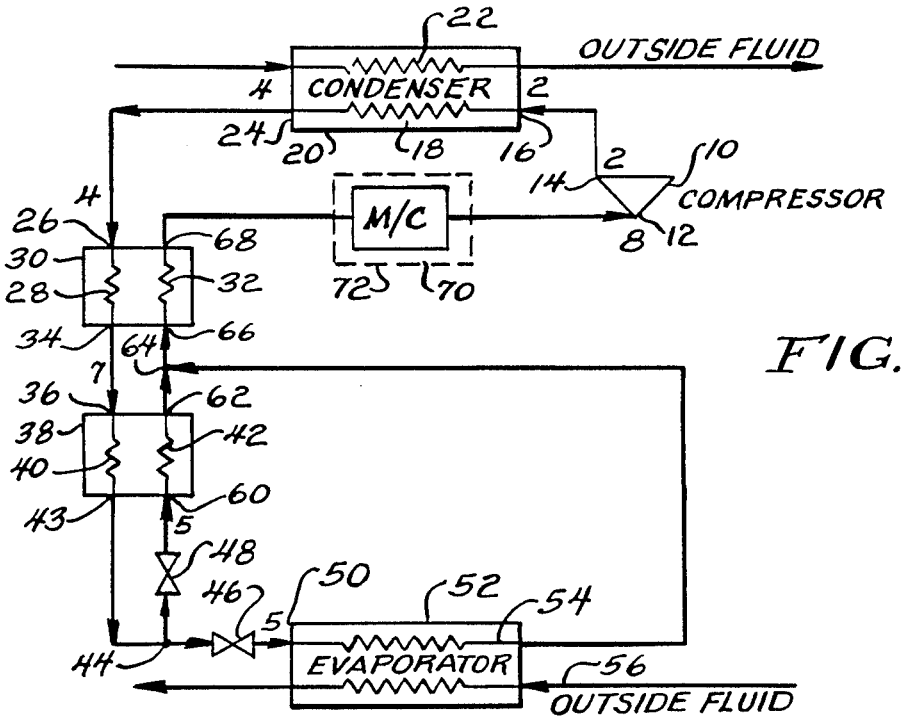
FIG. 1 is schematic showing a refrigeration/cooling system made according to the invention.

An exemplary embodiment of a refrigeration/cooling system made according to the invention as illustrated in FIG. 1 is seen to include a compressor, generally designated 10. The compressor 10 is a single stage compressor meaning that vapor being compressed is compressed to a single increased pressure level in one stage of compression.

The compressor 10 includes an inlet 12 for vapor to be compressed and an outlet 14 whereat compressed vapor may exit the compressor 10. According to the invention, the refrigerant or fluid operated upon by the compressor 10 will be a non-azeotropic binary fluid. One such fluid is made up of a 50-50 mole fraction mixture of R22 and R113. However, similar mixtures of other refrigerants may be utilized as desired. For example, mixtures of R13 and R113, R22 and R114, etc. may be utilized. Alternatively, other mole fractions may be utilized in making up the mixture.

The outlet 14 of the compressor 10 is connected to the inlet 16 of one flow path 18 in a condenser 20. A second flow path 22 in the condenser 20 conveys outside fluid in a countercurrent relationship for the purpose of cooling and condensing vapor flowing the flow path 18.

The flow path 18 has an outlet 24 from the condenser 20 which is connected to the inlet 26 of a first flow path 28 of a first heat exchanger 30. The heat exchanger 30 has a second flow path 32 which is in countercurrent relationship to the flow path 28.

The first flow path 28 of the first heat exchanger 30 includes an outlet 34 which is connected to the inlet 36 of a second heat exchanger 38, and specifically, to the inlet 36 of a first flow path 40 within the second heat exchanger 38. The flow path 40 is in countercurrent relation to a second flow path 42 within the second heat exchanger 38.

The first flow path 40 has an outlet 42 which is connected to a first junction 44 on the inlet side of first and second expansion valves 46 and 48 respectively. The expansion valve 46 is connected to a fluid inlet 50 of an evaporator 52, the evaporator 52 having a fluid outlet 54 and providing for countercurrent cooling of outside fluid indicated by a stream 56. Condensed fluid from the condenser 20 is expanded by the expansion valve 46 and evaporates within the evaporator 52 as is well known.

The expansion valve 48 interconnects the first junction 44 and the inlet 60 to the second flow path 42 of the second heat exchanger 38. The expansion valve 48 thus causes some vaporization of the refrigerant within the second heat exchanger 38 which operates to cool the refrigerant passing through the first flow path 40 thereof.

Refrigerant in the second flow path 42 of the second heat exchanger 38 exits via an outlet 62 to a second junction 64 which is also connected to the outlet 54 of the evaporator 52. In other words, the streams that divide at the junction 44 are recombined at the junction 64.

The junction 64 is connected to the inlet 66 of the second flow path 32 of the first heat exchanger 30. The passage of refrigerant through the second flow path 32 of the first heat exchanger 30 cools refrigerant flowing in the flow path 28 after being supplied thereto by the condenser 20.

Because the flows in the first and second heat exchangers 30 and 38 are countercurrent, it is possible to obtain relatively constant and highly efficient temperature differentials throughout the range of heat exchange occurring in each to maximize system efficiency.

Refrigerant exiting the second flow path 32 of the first heat exchanger 30 at an outlet 68 is applied to a motor/controller 70 for the compressor 10. Typically, the motor for driving the compressor 10 and electric or electronic controls therefore will be housed in a fluid tight housing shown schematically at 72 and the flowing of refrigerant through the same on the way to the inlet 12 for the compressor 10 as illustrated in FIG. 1 provides for cooling of the motor and the control circuits. However, in some instances, such cooling may not be necessary or even desirable, in which case the flow path from the outlet 68 to the inlet 12 via the motor/controller means 70 may be omitted in favor of a direct connection.

Figure 2:
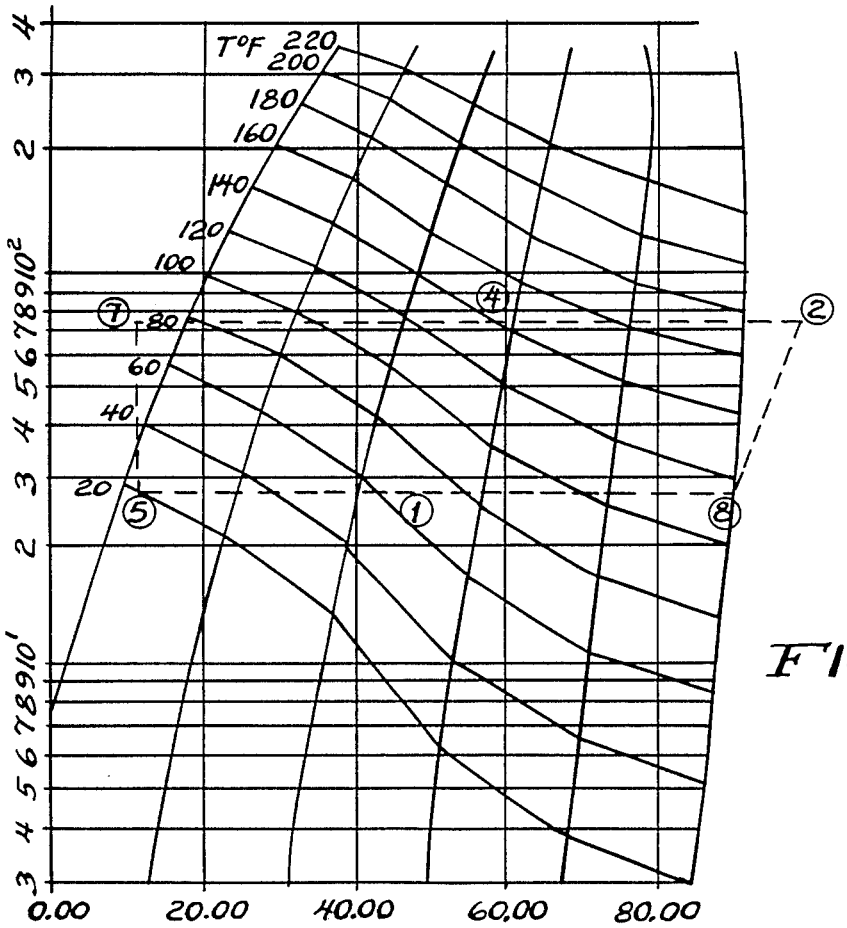
FIG. 2 is a pressure versus enthalpy diagram showing system operation when an non-azeotropic binary fluid composed of a 50/50 mole fraction of R22 and R113 are utilized as the refrigerant.

FIG. 2 illustrates a plot of pressure versus enthalpy during the operation of a system made according to the invention. The refrigerant utilized is a mixture of R22 and R113 of equal mole fractions as mentioned previously.

Looking at the plot at a starting point corresponding to the vapor inlet 12 to the compressor 10, it will be seen that the compressor 10 compresses the refrigerant raising its pressure somewhat over three fold along the line 8-2 which is then applied to the condenser 22. Within the condenser 20, the refrigerant is cooled and partially condensed at substantially constant pressure as indicated at point 4 and then is further cooled at substantially constant pressure in the heat exchangers 30 and 38 as indicated by the line **4-7*a*. Pressure is then reduced at the the expansion valves 46, 48 as shown by line *7a*-5 and the temperature of the expanded fluid is then raised within the evaporator 52 and the second heat exchanger 38 as shown by the line 5-1 to respectively cool the outside fluid stream 56 and the incoming refrigerant in the flow path 40**.

As noted in FIG. 2, condensation in the condenser, (process points 2-4) and evaporation in the evaporator and second heat exchanger 38 (process points 5-1) are incomplete or partial. The exact extent of these processes will of course depend upon the application and the refrigerant mixture used. Partial condensation and evaporation contribute to the reduction in the pressure ratio. The binary mixture is selected to achieve this while at the same time obtaining high efficiency operation in a given application.

Figure 3:
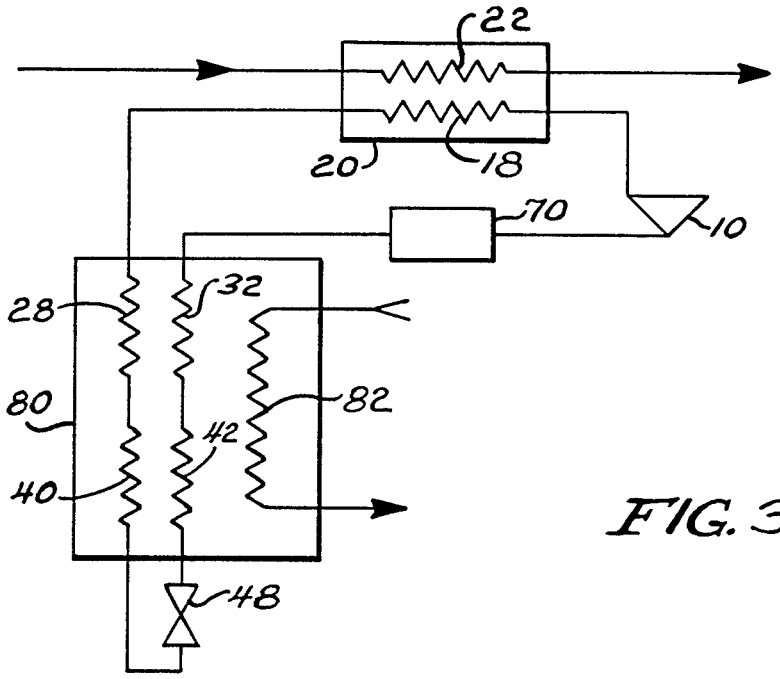
FIG. 3 is a schematic showing a modified embodiment of a refrigeration/cooling system made according to the invention.
Figure 4:
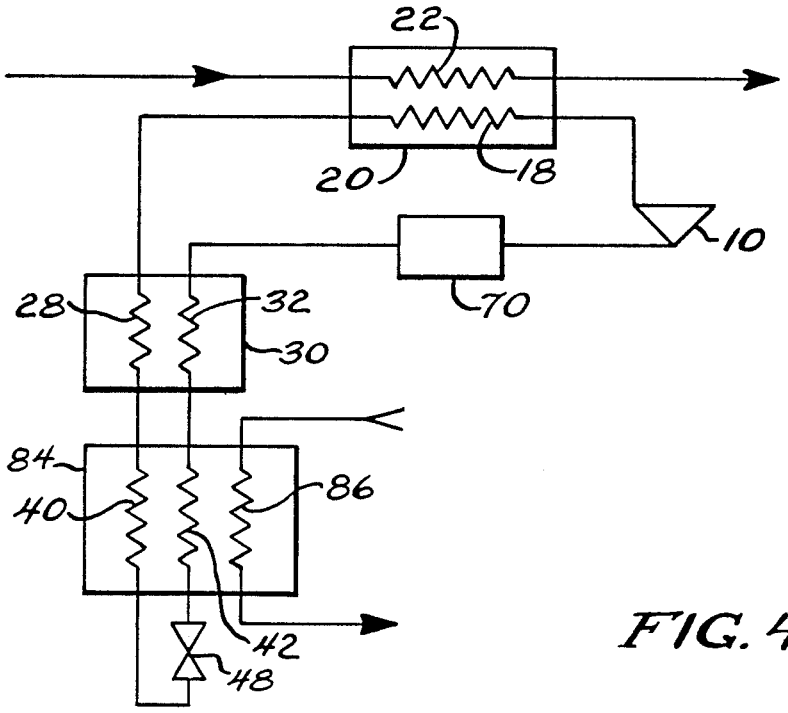
FIG. 4 is a schematic showing a further modified embodiment of a refrigeration/cooling system made according to the invention.

FIGS. 3 and 4 show modified embodiments of refrigeration/cooling systems made according to the invention. In the interest of brevity, components of the embodiments illustrated in FIGS. 3 and 4 that are the same as components of the embodiment illustrated in FIG. 1 will not be redescribed and will be given the same reference numerals.

Addressing the embodiment of FIG. 3 specifically, in this embodiment, the heat exchangers 38 and 40 and the evaporator 52 are combined in a single unit or housing 80. A single flow path 82 within the housing 80 constitutes the flow path for outside fluid such as outside air which is intended to be cooled by refrigerant within the housing 80. According to this embodiment, the expansion valve 46 and the junctions 44 and 64 are eliminated.

FIG. 4 illustrates a similar embodiment wherein the first heat exchanger 30 is retained as a separate entity but the second heat exchanger 38 and the evaporator 52 are combined in a single housing 84. A flow path 86 is contained within the housing for outside fluid to be cooled. As with the embodiment in FIG. 3, the junctions 44 and 64 along with expansion valve 46 are eliminated.

In the embodiments of both FIGS. 3 and 4 the flow paths 82 (FIG. 3 and 86 (FIG. 4) are in countercurrent heat exchange relation with the second flow path 42. The second flow path 42 is, of course, in countercurrent heat exchange relation with the first flow path 40, as mentioned in the description of FIG. 1.

It will also be appreciated that desired temperature differentials, which are relatively constant, are maintained throughout the various heat exchange devices so it is not necessary to increase the flow rate of the heat sink stream in order to maintain them. Thus, considerably less energy is required to operate the system.

I claim:

1. A vapor compression cooling system utilizing a non-azeotropic binary fluid and operating at a pressure ratio of about 4 or less and comprising:

a single stage compressor for said binary fluid and operable, in a single compression step, to compress the vapor of said binary fluid, said compressor having an inlet and an outlet;

a condenser connected to said compressor outlet for receiving compressed vapor of said binary fluid and cooling the same to at least partially condense said vapor;

an evaporator for at least partially evaporating condensed vapor and including a fluid inlet and a fluid outlet, a first expansion device connected to said fluid inlet;

a first heat exchanger having a first flow path connected to said condenser and a second flow path in countercurrent relation to said first flow path and in fluid communication with said compressor inlet;

a second heat exchanger having a first flow path connected to the first flow path of said first heat exchanger and to said first expansion device at a first junction and a second flow path in countercurrent relation to said first flow path and connected at a second junction to said first heat exchanger second flow path;

a second expansion valve interposed between said first junction and said second heat exchanger second flow path; and means interconnecting said evaporator fluid outlet with said second junction;

said first and second heat exchangers being the sole heat exchangers interposed between said condenser and said evaporator and said first and second expansion devices being the sole expansion devices in said system.

2. The vapor compression cooling system of claim 1 wherein said compressor includes motor/controller means and wherein said first heat exchanger second flow path is in fluid communication with said compressor inlet via said motor/controller means to cool the same.

3. A vapor compression cooling system utilizing a non-azeotropic binary fluid and operating at a pressure ratio of about 4 or less and comprising a single stage compressor for said binary fluid and operable, in a single compression step, to compress the vapor of said binary fluid, said compressor having an inlet and an outlet;

a condenser connected to said compressor outlet for receiving compressed vapor of said binary fluid and cooling the same to at least partially condense said vapor;

an evaporator for at least partially evaporating condensed vapor and including a fluid inlet and a fluid outlet, a first expansion device connected to said fluid inlet;

a first heat exchanger having a first flow path connected to said condenser and a second flow path in countercurrent relation to said first flow path and in fluid communication with said compressor inlet;

a second heat exchanger having a first flow path connected to the first flow path of said first heat exchanger and to said first expansion device at a first junction and a second flow path in countercurrent relation to said first flow path and connected at a second junction to said first heat exchanger second flow path;

a second expansion device interposed between said first junction and said second heat exchanger second flow path; and means interconnecting said evaporator fluid outlet with said second junction;

said first and second heat exchangers being the sole heat exchangers interposed between said condenser and said evaporator.

4. A vapor compression cooling system utilizing a non-azeotropic binary fluid and operating at a pressure ratio of about 4 or less and comprising a single stage compressor for said binary fluid and operable, in a single compression step, to compress the vapor of said binary fluid, said compressor having an inlet and an outlet;

a condenser connected to said compressor outlet for receiving compressed vapor of said binary fluid and cooling the same to at least partially condense said vapor;

an evaporator for at least partially evaporating condensed vapor and including a fluid inlet and a fluid outlet, a first expansion device connected to said fluid inlet;

a first heat exchanger having a first flow path connected to said condenser and a second flow path in countercurrent relation to said first flow path and in fluid communication with said compressor inlet;

a second heat exchanger having a first flow path connected to the first flow path of said first heat exchanger and to said first expansion device at a first junction and a second flow path in countercurrent relation to said first flow path and connected at a second junction to said first heat exchanger second flow path;

a second expansion device interposed between said first junction and said second heat exchanger second flow path; and means interconnecting said evaporator fluid outlet with said second junction;

said first and second expansion devices being the sole expansion devices in said system.

5. A vapor compression cooling system utilizing a non-azeotropic binary fluid and operating at a pressure ratio of about 4 or less and comprising a single stage compressor for said binary fluid and operable, in a single compression step, to compress the vapor of said binary fluid, said compressor having an inlet and an outlet;

a condenser connected to said compressor outlet for receiving compressed vapor of said binary fluid and cooling the same to at least partially condense said vapor;

an evaporator for at least partially evaporating condensed vapor and including a fluid inlet and a fluid outlet, a first expansion device connected to said fluid inlet;

a first heat exchanger having a first flow path connected to said condenser and a second flow path in countercurrent relation to said first flow path and in fluid communication with said compressor inlet;

a second heat exchanger having a first flow path connected to the first flow path of said first heat exchanger and to said first expansion device at a first junction and a second flow path in countercurrent relation to said first flow path and connected at a second junction to said first heat exchanger second flow path;

a second expansion device interposed between said first junction and said second heat exchanger second flow path; and means interconnecting said evaporator fluid outlet and said second junction.

6. A vapor compression cooling system utilizing a non-azeotropic binary fluid and operating at a pressure ratio of about 4 or less and comprising:

a single stage compressor for said binary fluid and operable, in a single compression step, to compress the vapor of said binary fluid, said compressor having an inlet and an outlet;

a condenser connected to said compressor outlet for receiving compressed vapor of said binary fluid and cooling the same to at least partially condense said vapor; and heat exchange means disposed to receive said at least partially condensed vapor from said compressor and interconnecting said compressor and said condenser, said heat exchange means including first, second and third flow paths, said first and third flow paths each being in heat exchange relation with said second flow path, said first and second flow paths being in countercurrent relation with each other and connected to each other by expansion valve means, said third flow path being adapted to receive a fluid to be cooled.

7. The vapor compression cooling system of claim 6 wherein said first, second and third flow paths are contained within a single heat exchanger housing.

8. A vapor compression cooling system according to claim 6 wherein said first, second and third flow paths are located in two distinct heat exchanger housings.

9. The vapor compression cooling system of claim 6 wherein said first, second and third flow paths are in three distinct heat exchanger housings and said second flow path has two branches.

* * * * *